US005615769A

United States Patent [19]

Stephenson

[11] Patent Number: 5,615,769

[45] Date of Patent: Apr. 1, 1997

[54] SPORTS BALL BAG

[76] Inventor: Stanley L. Stephenson, 7121 Alabama Hwy. 101, Town Creek, Ala. 35672

[21] Appl. No.: 556,513

[22] Filed: Nov. 13, 1995

[51] Int. Cl.[6] ..... A45C 15/00

[52] U.S. Cl. ..... 206/315.9; 206/811; 224/901.6; 224/919; 383/76; 383/111

[58] Field of Search ..... 206/315.9, 315.91, 206/811; 224/919, 576, 610, 250, 901, 901.6, 901.2; 383/111, 4, 76

[56] References Cited

U.S. PATENT DOCUMENTS

| | | | |
|---|---|---|---|
| 1,269,276 | 6/1918 | Harris . | |
| 1,648,565 | 11/1927 | Primley | 206/315.9 |
| 1,745,590 | 2/1930 | Stanger | 224/576 |
| 1,748,087 | 2/1930 | Spanel . | |
| 3,225,806 | 12/1965 | Pollak et al. | 150/52 |
| 4,022,261 | 5/1977 | Russell | 383/111 |
| 4,421,150 | 12/1983 | Masters | 383/61 |
| 4,545,362 | 10/1985 | Hendricks | 206/315.9 |
| 4,693,402 | 9/1987 | Comeau | 224/919 |
| 4,822,177 | 4/1989 | Arend | 383/4 |
| 4,949,887 | 8/1990 | Holmes | 224/610 |
| 5,020,711 | 6/1991 | Kelley | 224/901 |
| 5,139,187 | 8/1992 | Fowler | 224/576 |
| 5,216,900 | 6/1993 | Jones | 224/901 |
| 5,289,960 | 3/1994 | Kelly et al. | 224/919 |
| 5,318,107 | 6/1994 | Bell | 383/110 |
| 5,323,802 | 6/1994 | Kiedrowski | 383/113 |
| 5,353,453 | 10/1994 | Naumann | 5/417 |

FOREIGN PATENT DOCUMENTS

| | | |
|---|---|---|
| 1236831 | 6/1960 | France . |
| 2094619 | 9/1982 | United Kingdom . |
| 2128076 | 4/1984 | United Kingdom . |

*Primary Examiner*—Bryon P. Gehman
*Assistant Examiner*—Luan K. Bui
*Attorney, Agent, or Firm*—Richard C. Litman

[57] ABSTRACT

A sports ball bag provides for the drying and warming care of a sports ball during the course of a ball game. The bag is particularly adapted for the care of one or more footballs placed therein, as would be used in the play of amateur and professional football games, but may be used for the care of balls used in other types of ball games as well. The bag is formed of a waterproof outer cover (e.g., vinyl) having an openable side closure and opposite openable end closures thereby allowing the cover to be laid out flat. A removable and replaceable moisture absorbent liner (e.g., a terry cloth towel) may be secured within the cover in order to dry the ball and to provide some thermal insulation properties. A warming device, such as a chemical hand warmer packet, may also be placed within the bag to warm any balls or other articles placed therein. The end closures are preferably draw strings in order to provide rapid access to the interior of the bag. An adjustable neck and shoulder strap is also provided so the user of the bag may have both hands free for removal and insertion of game balls within the bag during the course of the game.

14 Claims, 2 Drawing Sheets

SPORTS BALL BAG

FIELD OF THE INVENTION

The present invention relates generally to sports equipment, and more specifically to a bag or container providing for the care of a sports game ball during a ball game. The bag is adapted to be formed from a flat sheet of material, and includes means for drying and warming a ball placed therein. While the present bag is directed primarily to use in football games, it may also be used for the care of game balls used in other sports as well.

BACKGROUND OF THE INVENTION

Sports game balls used in various physical outdoor sports, such as football, baseball and softball, etc., are exposed to the prevailing elements during play. While baseball and softball are not generally played in inclement weather, the playing field may nevertheless be damp or wet from a previous rain or watering, and football is typically played no matter what the weather conditions may be.

As the balls used in these sports will contact the ground as a matter of course during play, the balls will of course take on the nature of the ambient conditions (damp, cold, etc.) This can have a considerable effect on the play of the game, as the game ball must be handled by the players during play. A damp or wet ball will have reduced coefficient of friction, leading to throwing errors, fumbles, and other mistakes during play, and all experienced players recognize the difficulty in gaining a good feel of a ball for accurate handling, when the ball is extremely cold.

Accordingly, a need will be seen for a device which provides care for a game ball between plays, by at least drying the ball, and which may also warm the ball at least to a certain degree if desired. The device must be capable of performing these functions during the course of an entire game of up to a few hours, and thus the moisture absorbing means therein must be interchangeable as it becomes dampened from contact with a wet ball. Simple heating means for the ball in the form of a chemical heating pad or container, may also be provided within the bag as required or desired. The bag should provide sufficient volume for more than a single game ball and should be capable of being opened completely to lie flat for cleaning or other maintenance as required. While the present bag is directed primarily toward U.S. football in its amateur and professional forms, due to the often cold and damp conditions which prevail in such games during the season and also due to the need for players to handle the ball, it will be seen that the present sports ball bag is also adaptable to use in the care of bells used in other physical sports as well.

DESCRIPTION OF THE PRIOR ART

U.S. Pat. No. 1,269,276 issued to Rebecca Harris on Jun. 11, 1918 describes an Army And Navy Pillow Kit, generally comprising a rectangular flat sheet of material having some form of closure means (buttons, snaps) disposed about the extreme periphery of the sheet. Two parallel draw strings are also provided, each spaced somewhat inwardly from opposite edges of the sheet. While the peripheral closures enable the device to be closed to form a bag or pouch, the inwardly located draw strings and peripheral closure means result in three separate enclosed volumes when the device is closed: A first volume between a first end and a first draw string, a second central volume between the two draw strings, and a third volume between the second draw string and the second end. Thus, in order to reach the central volume through one end, it would be necessary to (1) disengage at least some of the end closure fasteners, and (2) loosen the corresponding draw string. This is a cumbersome and time consuming process, compared to the single draw string end closure provided with the present sports ball bag. While a lateral seam could be opened for access to the central volume of the Harris device, such access is undesirable in the anticipated environment of the present invention, as it would expose a larger opening to the elements and allow more warmth to escape and moisture to enter the interior volume of the bag. Moreover, the Harris device does not have any form of strap to provide for the hands free carriage thereof, as provided by the present sports ball bag, and Harris does not disclose any form of moisture absorbent lining, either replaceable or permanent nor any form of heating means within the device when it is closed, which elements are a part of the present invention.

U.S. Pat. No. 1,748,087 issued to Abraham N. Spanel on Feb. 25, 1930 describes a Renovating And Oxygenizing Device, comprising a cylindrical bag of flexible air tight material, and having draw string adjustable end closures in one embodiment. A vacuum line communicates with a point medially along the bag, to draw air from the bag, through the end closures, and through any articles within the bag. No side closure is disclosed, and the bag cannot be laid out flat, as with the present invention. No carrying strap, moisture absorbent liner, or heating means is disclosed by Spanel, as provided by the present sports ball bag.

U.S. Pat. No. 3,225,806 issued to Victor S. Pollack et al. on Dec. 8, 1955 describes a Carrying Bag Construction, adapted for the carriage and storage of a bowling ball therein. The bag includes only a single top opening which is closable by means of a draw string or other mechanism, and a solid bottom platform for the support of the relatively heavy bowling ball. As such, the bag is relatively rigid and inflexible, unlike the present sports ball bag with its flexible sheet material construction and side and opposite end openings. A prime emphasis of Pollak et al. is to construct a bag which requires only a relatively short carrying handle, whereas the present sports ball bag is intended to be supported by a relatively long strap about the neck of a user, so as to allow both hands to be free. Moreover, Pollak et al. do not disclose any means for drying or warming a ball within their bag, as such is not ordinarily required of a bowling ball.

U.S. Pat. No. 4,421,150 issued to William E. Masters on Dec. 20, 1983 describes a Waterproof Bag Device For Articles, comprising a bag having a single generally tubular opening at the top thereof. The opening is adapted to be rolled for closure, and sealed by a Velcro (tm) flap thereover. The device is intended to be completely waterproof for at least some period of time, in the event of submersion while boating or whitewater rafting. In contrast, the present invention is only intended to prevent atmospheric moisture from further dampening articles within the bag, and need not provide safety from total submersion. As a result, the present bag interior is much more accessible, by means of its side and opposite end openings. Moreover, Masters does not provide any exterior carrying strap or interior moisture absorbent or heating means for his bag, as provided by the present invention.

U.S. Pat. No. 4,545,362 issued to Willard E. Hendricks on Oct. 8, 1985 describes a Golf Ball Heater, comprising a rigid cylindrical container having closed opposite ends. One side is openable for access to golf balls and/or a chemically reactive hand heating pad insertable therein. The device is not waterproof, as holes are provided in the side thereof for air circulation, in order to activate the heating pad. No carrying strap is provided, due to the small size of the device given its intended use and environment. Moreover, no means is provided for drying any golf balls contained within the device, as provided by the present sports ball bag.

U.S. Pat. No. 5,318,107 issued to Rebecca Bell on Jun. 7, 1994 describes a Carrying Bag adapted for use in the carriage of supplies (diapers and bottles) for infants. The structure has a rigid frame and an electrical heating element in one portion thereof. Space for a plurality of diapers is provided therewithin, with diapers of course being moisture absorbent by their nature. However, Bell does not provide for the removable securing of a single diaper disposed over the interior surface of the container, as provided by a moisture absorbent towel in the present invention.

U.S. Pat. No. 5,323,802 issued to Rosalie Kiedrowski on Jun. 28, 1994 describes an Umbrella Bag, having a moisture repellent (but not waterproof) outer shell and a moisture absorbent inner lining permanently secured thereto. The bag is generally cylindrical, but has only a single openable end, with the opposite end and side being permanently closed. The openable end is adjustably closable by draw strings, which may be used as a carrying handle, but the only adjustability is dependent upon the diameter of the opening which they surround.

U.S. Pat. No. 5,353,453 issued to Mary D. Naumann on Oct. 11, 1994 describes a Tanning Towel With Reflective Surface, comprising a sheet of material having a flexible reflective surface and an opposite moisture absorbent surface. No disclosure is made of the reflective material also being waterproof or moisture proof, as required by the bag material of the present invention. As the Naumann device is clearly described as a "Towel," it would appear desirable that the entire device be moisture absorbent, or at least not be waterproof, and thus the Naumann composite material would not appear to be suitable for use in the construction the present bag. Naumann makes no disclosure of any other construction than as a flat sheet of material, or joined plural flat sheets.

French Patent Publication No. 1,236.831 to MM. Paul Duffy et al. and published on Jun. 13, 1960 describes a draw string closure for a bag or sack, wherein a tube of fabric or other flexible sheet material is secured adjacent the single opening of the sack and a draw string passed therethrough. While the present invention may make use of a similar end closure configuration, no openable side, moisture proof outer sheet, or inner sheet of any sort, is disclosed in the French patent publication, as provided by the present sports ball bag.

British Patent Publication No. 2,094,613 to Martin A. Kearney et al. and published on Sep. 22, 1982, describes a Golf Ball Pocket constructed of a moisture absorbent terry cloth material, and adapted to be worn from a belt or the like. No moisture proof outer cover, heating means, openable side and opposite ends, or closure means for the single open end, is disclosed. As the device is adapted for use with golf balls, it is quite small and light weight, and no longer neck or shoulder strap is provided.

Finally, British Patent Publication No. 2,128 076 to Alaerai F. Noodle and published on Apr. 26, 1984 describes Bags For Holding Compressible Articles, comprising a cylindrical flexible fabric container having a single openable end. The opposite end is closed, and although one side is expandable, that side has a tapered gore of material therein which allows only expansion of the diameter of that portion of the cylindrical shape, but does not provide for opening of the side. No waterproof outer cover, moisture absorbent inner liner, heating means, or neck and shoulder strap, is disclosed by the British publication.

None of the above noted patents, taken either singly or in combination, are seen to disclose the specific arrangement of concepts disclosed by the present invention.

SUMMARY OF THE INVENTION

By the present invention, an improved sports ball bag is disclosed.

Accordingly, one of the objects of the present invention is to provide an improved sports ball bag which is adapted for the drying and warming care of a sports ball during the play of a ball game, such as football, baseball, softball, or other ball games Another of the objects of the present invention is to provide an improved sports ball bag which includes opposite openable ends and an openable side, and is adapted to be laid out flat for cleaning, maintenance, or other purposes.

Yet another of the objects of the present invention is to provide an improved sports ball bag which openable side is closeable by means of hook and loop fastening material, or other suitable closure means.

Still another of the objects of the present invention is to provide an improved sports ball bag which ends are adjustably closable by draw string means.

A further object of the present invention is to provide an improved sports ball bag which outer cover is formed of a waterproof material, to preclude atmospheric moisture from dampening the interior thereof and/or any articles therein An additional object of the present invention is to provide an improved sports ball bag which includes a removable and replaceable moisture absorbent inner liner, adapted to dry any articles placed within the bag and to provide some thermal insulation by means of a napped pile surface.

Another object of the present invention is to provide an improved sports ball bag which includes an adjustable neck or shoulder strap, and which is adapted for hands free wearing by a user of the bag.

Yet another object of the present invention is to provide an improved sports ball bag which may include heating means therein for any articles removably placed therewithin.

A final object of the present invention is to provide an improved sports ball bag for the purposes described which is inexpensive, dependable and fully effective in accomplishing its intended purpose With these and other objects in view which will more readily appear as the nature of the invention is better understood, the invention consists in the novel combination and arrangement of parts hereinafter more fully described, illustrated and claimed with reference being made to the attached drawings.

DETAILED DESCRIPTION OF THE PREFERRED EMBODIMENT

Figure 1:
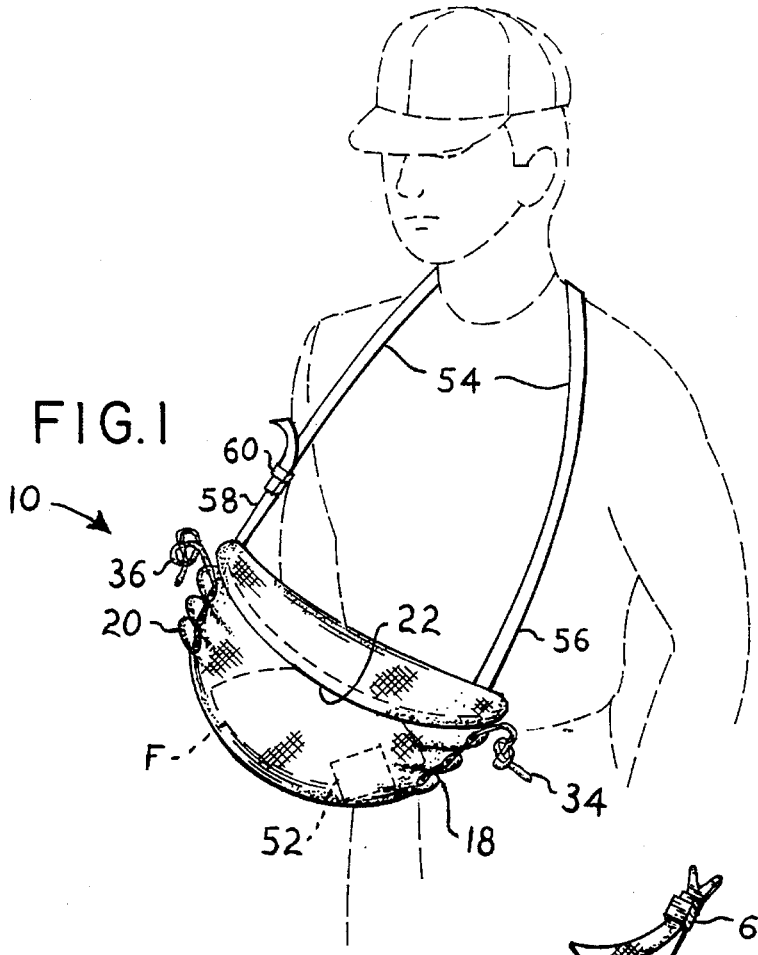
FIG. 1 is an environmental perspective view of the present sports ball bag, showing the bag in use and providing care for a sports game ball removably placed therein
Figure 2:
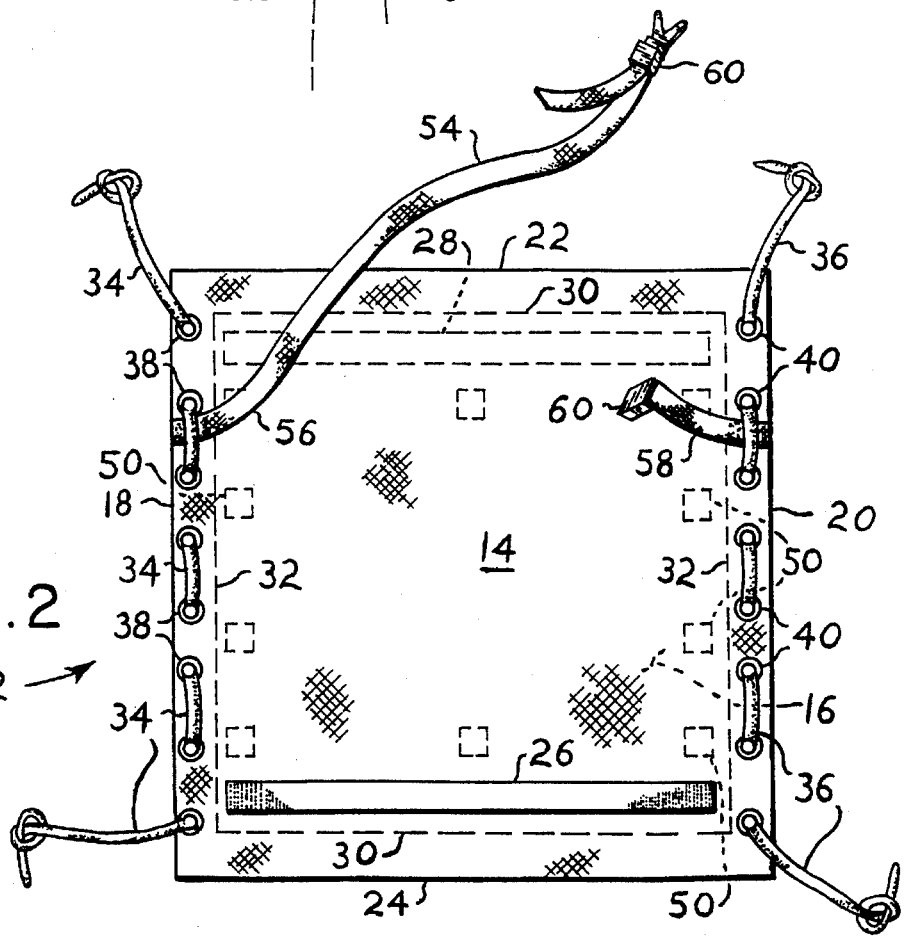
FIG. 2 is a top plan view of the exterior surface of the sports ball bag with all of its end and side closures opened, and with the bag laid out to form a flat sheet

Referring now particularly to FIGS. 1 and 2 of the drawings, the present invention will be seen to relate to a sports ball bag 10 providing for the drying and warming care of a sports ball or plural balls (e.g., the football F shown in broken lines within the bag 10) during the course of play of a ball game. The bag 10 generally comprises a flat, thin, flexible, waterproof, rectangular sheet of material 12 (e.g., vinyl coated fabric) having a vinyl of otherwise coated outer surface 14 and an opposite inner surface 16 (shown more clearly in FIG. 3), a first end 18 and an opposite second end 20, and a first edge 22 and an opposite second edge 24.

The first or outer surface 14 includes a long, continuous first strip of hook and loop fastening material 26 (e.g., Velcro, tm) disported thereon and parallel and close to the second edge 24, while the second, inner surface 16 includes a long and continuous second strip of cooperating hook and loop material 28 disposed thereon, parallel and close to the first edge 22 of the sheet 12. The two mating strips 26 and 28 are installed immediately adjacent their respective edge hem 30 along each edge 22 and 24, and are limited by the end hems 32 along each end 13 and 20 of the sheet 12. Thus, the sheet 12 may be folded to position the second length of hook and loop material 28 to overlie the first length of material 26, and the two joined together so that the first edge 22 overlaps the second edge 24 of the sheet 12 to form a selectively openable side closure seam.

Figure 3:
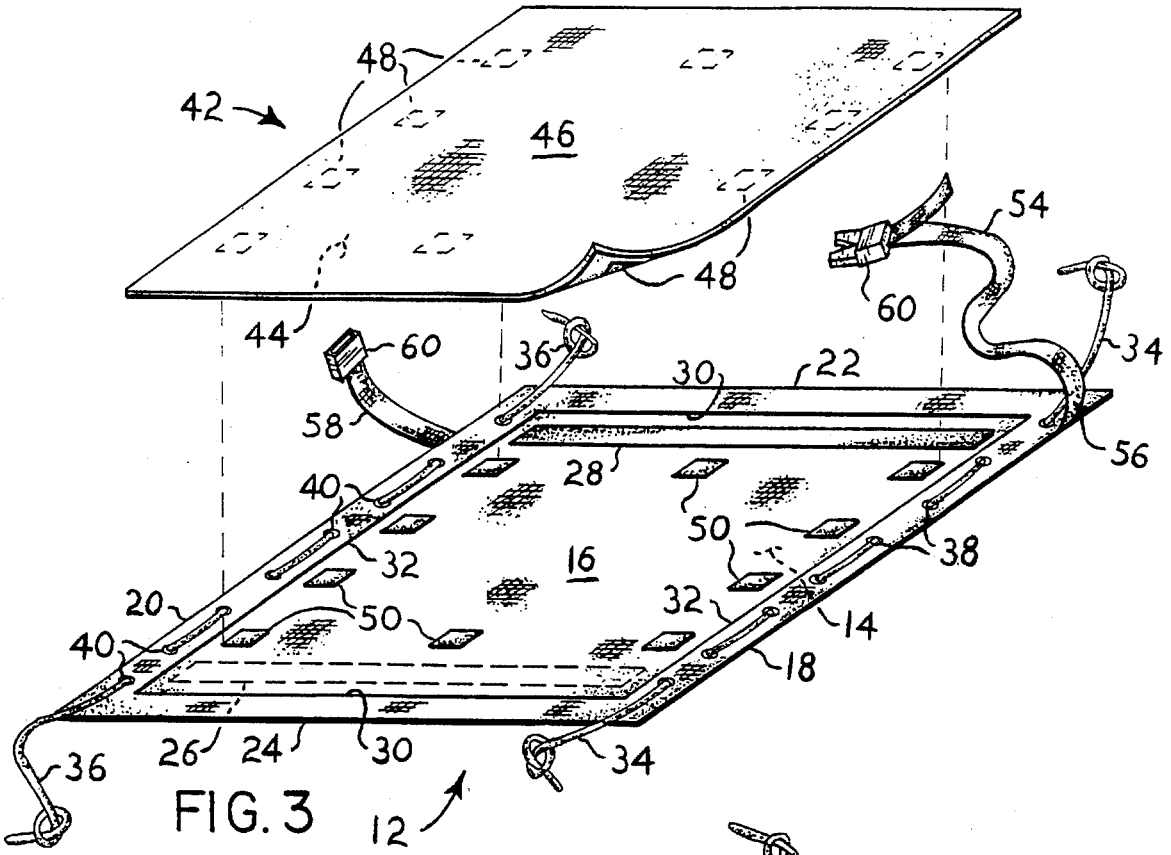
FIG. 3 is an exploded perspective view of the interior surface of the sports ball bag in an opened and laid flat configuration, with a removable towel or moisture absorbent sheet shown thereabove.

The two ends 18 and 20 of the sheet 12 are also selectively closeable, by means of first and second draw strings 34 and 36 woven through two sets of grommets, respectively 38 and 40, installed respectively along each edge 18 and 20. The draw strings 34/36 are woven alternatingly through their respective grommets 38/40 of their respective ends 18/20, to pass alternatingly over a portion of the outer and inner surfaces 14 and 16. Thus, when the side closure seam is overlappingly closed by means of the cooperating hook and loop material 26/28, and the draw strings 34/36 are drawn closed to secure their respective ends 18/20, the flat sheet of material 12 of FIG. 2 and 3 is selectively closed to form a closed container or bag 10, as shown in FIG. 1. As the two ends 18 and 20 are mirror images of one another, either draw string 34/36 may he selectively opened or closed to access the interior or to close the sports ball bag 10, as desired FIG. 3 provides an exploded perspective view of the inner surface 16 of the unfolded, flat bag 10 formed of the sheet 12, and an inner lining 42 therefor. The lining 42 comprises a flat, rectangular sheet having an outwardly facing (i.e., away from the interior of the bag 10 and toward the inner surface of the cover sheet 12 forming the bag 10) cover contact surface 44, and an opposite, inwardly facing (i.e., toward the interior of the bag 10) surface 46. Preferably, the lining 42 is a terry cloth material, with a relatively thick, moisture absorbent nap material disposed over at least the inwardly facing surface 46. The relatively thick nap material may also provide some thermal insulation, particularly when dry, as well as being moisture absorbent.

The lining 42 includes a plurality of spaced apart first hook and loop fastener components 48 installed thereon adjacent the periphery of the lining 42, while the inner surface 16 of the bag or liner cover 12 includes a corresponding plurality of spaced apart cooperating second hook and loop fastener components 50 disposed therearound and adapted to engage the first hook and loop fastener components 48 of the liner 42 to secure the liner 42 within the bag or cover 12 removably as desired. The liner 42 is preferably slightly smaller than the dimensions of the cover sheet 12, in order to fit within the hems 30 and 32 and to provide clearance for the draw strings 34 and 36 in their respective ends 18 and 20, and also to provide clearance for the overlapping first and second edges 22 and 24 and their hook and loop fastener closures 25 and 28.

In addition to the moisture absorbent and thermally insulating properties provided by the removable liner 42 discussed immediately above, the present sports ball bag 10 may also include means for heating a ball or balls therein, between plays during the course of a ball game. A thermochemical hand warming pad 52, or the like, may be removably placed within the bag 10 to warm a ball(s) or other article(s) enclosed therein. With the first and second edge closure and the draw string end closure means, the bag 10 may be reasonably tightly secured to preclude substantial heat loss therefrom, yet sufficient air is allowed to flow through the bag 10 by means of the oppositely disposed draw string ends to activate the thermochemical hand warmer pad or pack 52 enclosed therein. When the thermochemical reaction has dissipated, a new, fresh pad 52 may be enclosed in the bag 10 to provide continuing warmth.

During the course of play of a typical ball game, the game ball is exchanged numerous times for a clean and dry ball, as the ball in play becomes wet, muddy, or otherwise soiled. Accordingly, the ball boy or person handling this assignment, must have his hands free to catch a ball being taken out of play, and to toss a fresh ball back in to a game official. The present sports ball bag 10 provides for this hands free requirement, by a neck and shoulder strap 54. The strap 54 has a first end 56 secured adjacent the first end 18 of the bag 10 or sheet 12, and an opposite second end 58 secured to the opposite second end 20. A cooperating buckle or latch 60 is provided along the strap 54, which latch 60 serves to secure the two lengths 56 and 58 together and to adjust the length of the strap 54. Preferably, the strap 54 is sufficiently long so as to pass around the back of the neck of a user of the bag 10, with the bag 10 suspended at about the waist level of the user.

Figure 4:
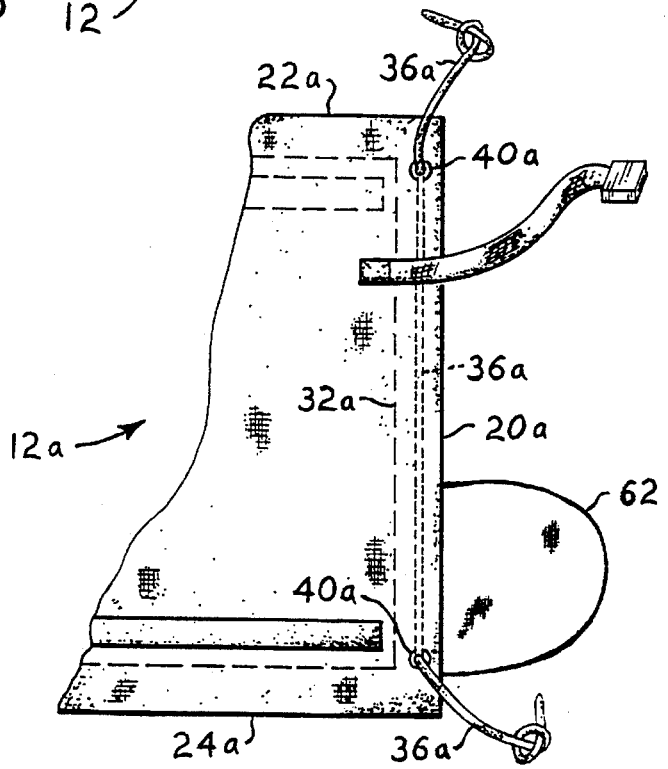
FIG. 4 is a broken away top plan view of an alternative embodiment of the present sports ball bag, showing an optional end closure flap and alternative end draw string installation Similar reference characters denote corresponding features consistently throughout the several figures of the attached drawings.

FIG. 4 provides a plan view of a portion of an alternate embodiment of the sheet 12 of FIGS. 2 and 3, which is used to form the bag 10 of FIG. 1. A sheet **12*a* is provided in FIG. 4, having construction similar to that described above in FIG. 2 and 3, but including two alternative features. First, it will be noted that the draw string 36*a* is not woven through a plurality of grommets disposed in the hem, but rather passes through the space formed by the folded over doubled end sheets of material used to form the tubular hem 32*a*. A grommet 40*a* may be installed at each end of the hem 32*a*, if desired, or alternatively the draw string 36*a* may pass through the end of the hem 32*a* and out the upper and lower edges 22*a* and 24*a* of the sheet 12*a*. Second, an end closure flap 62 may be provided for further sealing of the end 20*a* of the bag formed from the sheet 12*a*. The end closure flap 62 has a width of half or less the length of the end 20*a*, and may be tucked or folded into the bag to provide additional sealing when the draw string 36*a* (or 36) is drawn to close the end 20*a* of the bag. It will be understood that these features may be incorporated at both ends of a sports ball bag as desired, either singly or together and that the single end 20***a* of the sheet 12*a* shown in FIG. 4 is exemplary.

In summary, the present sports ball bag 10 will be seen to respond to a long standing need in the sports field, by providing a means of cleaning, drying, and warming game balls during the course of play of a ball game. While the present invention is primarily directed to use with footballs, and is capable of containing more than a single football, it will be seen that it can he readily used with other types of game balls which may require such cleaning, drying, and/or warming from time to time in a game.

The present sports ball bag is used by a ball boy or other person responsible for the care of the tame ball(s) applying a clean and dry liner towel 42 to the interior surface 16 of the sheet 12 comprising the cover of the bag 10, as described above. The side seam is then sealed by means of the cooperating hook and loop fastening material 26/28, and the two ends 18/20 are closed by means of their respective draw strings 34/36, with a warming pad 52 and ball being placed within the bag 10 as desired prior to the final end closure. The bag 10 is then donned by the ball boy or other person, by means of the adjustable neck and shoulder strap 54. As a fresh ball is needed from time to time during the course of play of the game, the clean, dry, and warm ball enclosed in the present bag 10 may be removed by opening one of the draw string ends 18/20, and the ball previously in play exchanged therefor. The terry cloth nap of the liner 42 serves to clean and dry the second ball, with the thermochemical warmer 52 serving to warm the ball for future use. This process is continued throughout the course of the game as required. When the liner 42 becomes too soiled or damp to perform its desired function, the bag 10 is easily opened and the old liner 42 exchanged for a fresh one, in the manner described above. The thermochemical warming pad 52 is also easily exchanged when depleted. Thus, the present invention will provide a clean, dry, and warm game ball throughout the course of a ball game, thereby enabling players to perform at peak efficiency and to avoid errors due to poor grip on a cold, wet, and/or slippery game ball during play.

It is to be understood that the present invention is not limited to the sole embodiments described above, but encompasses any and all embodiments within the scone of the following claims.

I claim:

1. A sports ball bag, comprising:

a cover comprising a flat, thin, flexible, waterproof, rectangular sheet of material having an outer surface and an opposite inner surface, a first end and an opposite second end with each said end having selectively openable closure means, a first edge and an opposite second edge with each said edge cooperating to form a selectively openable side closure seam, with each said end and said side closure seam being selectively closed to form said sports ball bag, and;

a lining comprising a rectangular sheet of moisture absorbent material securable to said inner surface of said bag;

said lining being selectively removable from said bag, said lining having a cover contact surface having a periphery including a plurality of spaced apart first hook and loop fastener components disposed therearound;

said inner surface of said cover having corresponding plurality of spaced apart cooperating second hook and loop fastener components disposed therearound and adapted to engage said first hook and loop fastener components of said liner selectively and removably, said inner surface of said cover including a continuous strip of first hook and loop fastener material disposed adjacent said first edge;

said outer surface of said cover including a continuous strip of cooperating second hook and loop fastener material disposed adjacent said second edge, with said first continuous strip and said second continuous strip being selectively engageable to provide for the overlapping securing of said first edge and said second edge to one another and the selective and openable closure of said side closure seam of said cover, whereby;

when a sports ball is placed within said sports ball bag by means of one said selectively openable end, the ball receives care and drying by means of said moisture absorbent lining of said bag and is precluded from contact with additional moisture by means of said waterproof cover of said bag.

2. The sports ball bag of claim 1, wherein:

each said end of said cover including a draw string means therein providing for the selectively openable closure thereof.

3. The sports ball bag of claim 2, wherein:

each said end of said cover includes a plurality of spaced apart grommets installed therein, with said draw string being woven alternatingly through said grommets.

4. The sports ball bag of claim 2, wherein:

each said end of said cover includes a tubular hem formed therealong, with said draw string disposed within said tubular hem.

5. The sports ball bag of claim 1, wherein:

said bag includes a neck and shoulder strap having a first end, an opposite second end, and an adjustable length, with said first end of said strap being secured adjacent said first end of said bag and said second end of said strap being secured adjacent said second end of said bag.

6. The sports ball bag of claim 1, wherein:

said cover comprises a fabric sheet having a surface with a vinyl plastic coating disposed thereover, with said vinyl plastic coating comprising said outer surface of said cover, and;

said lining comprises a sheet of terry cloth material having at least one surface with a thick nap thereon to provide moisture absorbent and thermal insulation for said bag.

7. The sports ball bag of claim 1, wherein:

at least one heating element is disposed within said bag.

8. The sport ball bag of claim 7, wherein:

said at least one heating element is removably disposed within said bag and comprises a chemically and thermally reactive pad.

9. The sports ball bag of claim 1, including:

an end closure flap disposed adjacent each side end of said bag.

10. A sports ball bag for receiving, warming, and drying a sports ball, said sports ball bag comprising:

a cover comprising a flat, thin, flexible, waterproof, rectangular sheet of material having an outer surface and an opposite inner surface, a first end and an opposite second end with each said end having selectively openable draw string closure, a first edge and an opposite second edge with each said edge cooperating to form a selectively openable side closure seam, with each said end and said closure seam being selectively closed to form said sports ball bag;

a selectively removable lining comprising a rectangular sheet of moisture absorbent material removably securable to said inner surface of said bag, said lining having a cover contact surface having a periphery including a plurality of spaced apart first hook and loop fastener components disposed therearound;

said inner surface of said cover having a corresponding plurality of spaced apart cooperating second hook and loop fastener components disposed therearound and adapted to engage said first hook and loop fastener components of said liner selectively and removably, said inner surface of said cover including a continuous strip of first hook and loop fastener material disposed adjacent said first edge;

said outer surface of said cover including a continuous strip of cooperating second hook and loop fastener material disposed adjacent said second edge, with said first continuous strip and said second continuous strip being selectively engageable to provide for the overlapping securing of said first edge and said second edge to one another and the selective and openable closure of said side closure seam of said cover;

said bag further including a neck and shoulder strap having a first end, an opposite second end, and an adjustable length, with said first end of said strap being secured adjacent said first end of said bag and said second end of said strap being secured adjacent said second end of said bag;

an end closure flap disposed adjacent each said end of said bag, and;

at least one heating element removably disposed within said bag, whereby;

said sports ball bag is held by a user thereof by means of said neck and shoulder strap to provide hands free access to said bag by the user, and when a sports ball is placed within said sports ball bag by said draw string closure of one said selectively openable end, the ball receives care, warming, and drying by means of said moisture absorbent lining of said bag and said at least one heating element removably disposed therein and is precluded from contact with additional moisture by means of said waterproof cover of said bag.

11. The sports ball bag of claim 10, wherein:

each said end of said cover includes a plurality of spaced apart grommets installed therein, with said draw string closure being woven alternatingly through said grommets.

12. The sports ball bag of claim 10, wherein:

each said end of said cover includes a tubular hem formed therealong, with said draw string closure disposed within said tubular hem.

13. The sports ball bag of claim 10, wherein:

said cover comprises a fabric sheet having a surface with a vinyl plastic coating disposed thereover, with said vinyl plastic coating comprising said outer surface of said cover, and;

said lining comprises a sheet of terry cloth material having at least one surface with a thick nap thereon to provide moisture absorbent and thermal insulation for said bag.

14. The sports ball bag of claim 10, wherein:

said at least one heating element comprises a chemically and thermally reactive pad.

* * * * *